US005897128A

United States Patent [19]

McKenzie et al.

[11] Patent Number: 5,897,128

[45] Date of Patent: Apr. 27, 1999

[54] PIVOTALLY ADJUSTABLE BINDING FOR SNOWBOARDS

[76] Inventors: Dennis McKenzie, 122 Strand St., Apt. 2, Santa Monica, Calif. 90405; Steven Claps, 18133 Coastline Dr. #3, Malibu, Calif. 90265

[21] Appl. No.: 08/658,057

[22] Filed: Jun. 4, 1996

[51] Int. Cl.[6] ..... A63C 9/00

[52] U.S. Cl. ..... 280/607; 280/618; 280/14.2

[58] Field of Search ..... 280/14.2, 607, 280/618, 601, 611, 613, 620, 633, 634, 630, 636, 813, 47.315, 65.1, 655

[56] References Cited

U.S. PATENT DOCUMENTS

| | | | |
|---|---|---|---|
| 5,354,088 | 10/1994 | Vetter et al. | 280/14.2 |
| 5,553,883 | 9/1996 | Erb | 280/14.2 |
| 5,577,755 | 11/1996 | Metzger et al. | 280/14.2 |
| 5,586,779 | 12/1996 | Dawes et al. | 280/14.2 |

OTHER PUBLICATIONS

Burton Snowboards Catalog, Copyright 1995 See pp. 20–21, 22–31, 42–43.

Santa Cruz Snowboards Mailer, 1995–96 season, Boots and Bindings depicted.

*Primary Examiner*—J. J. Swann
*Assistant Examiner*—Michael Mar
*Attorney, Agent, or Firm*—Trojan Law Offices; R. Joseph Trojan; Eric J. Aagaard

[57] ABSTRACT

A snowboard binding having a pivot plate located in the bottom sole of the binding. The pivot plate is held in place at the desired angle by a locking pin that engages receptacles radially positioned about a central axis of the pivot plate in which the locking pin can be inserted. The locking mechanism also has a spring loaded indicator shaft to show if the binding is in a fully locked position.

3 Claims, 3 Drawing Sheets

FIG. 1
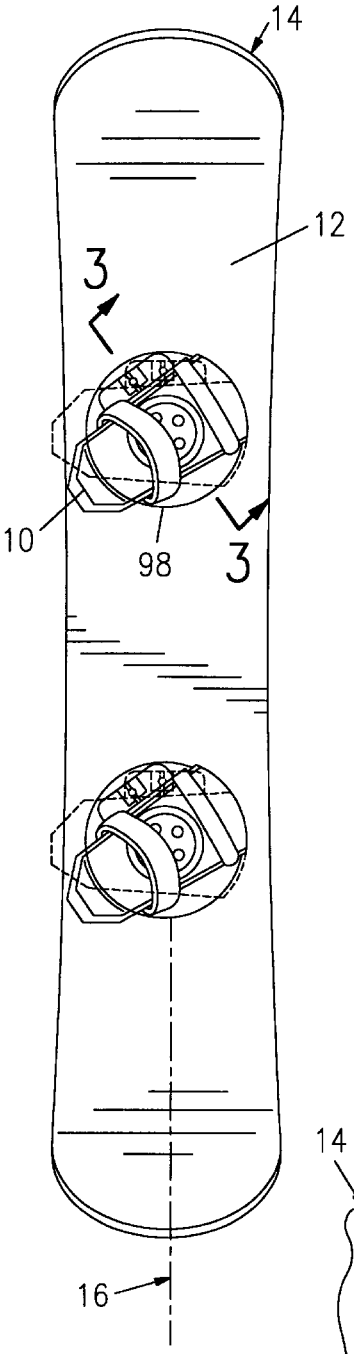
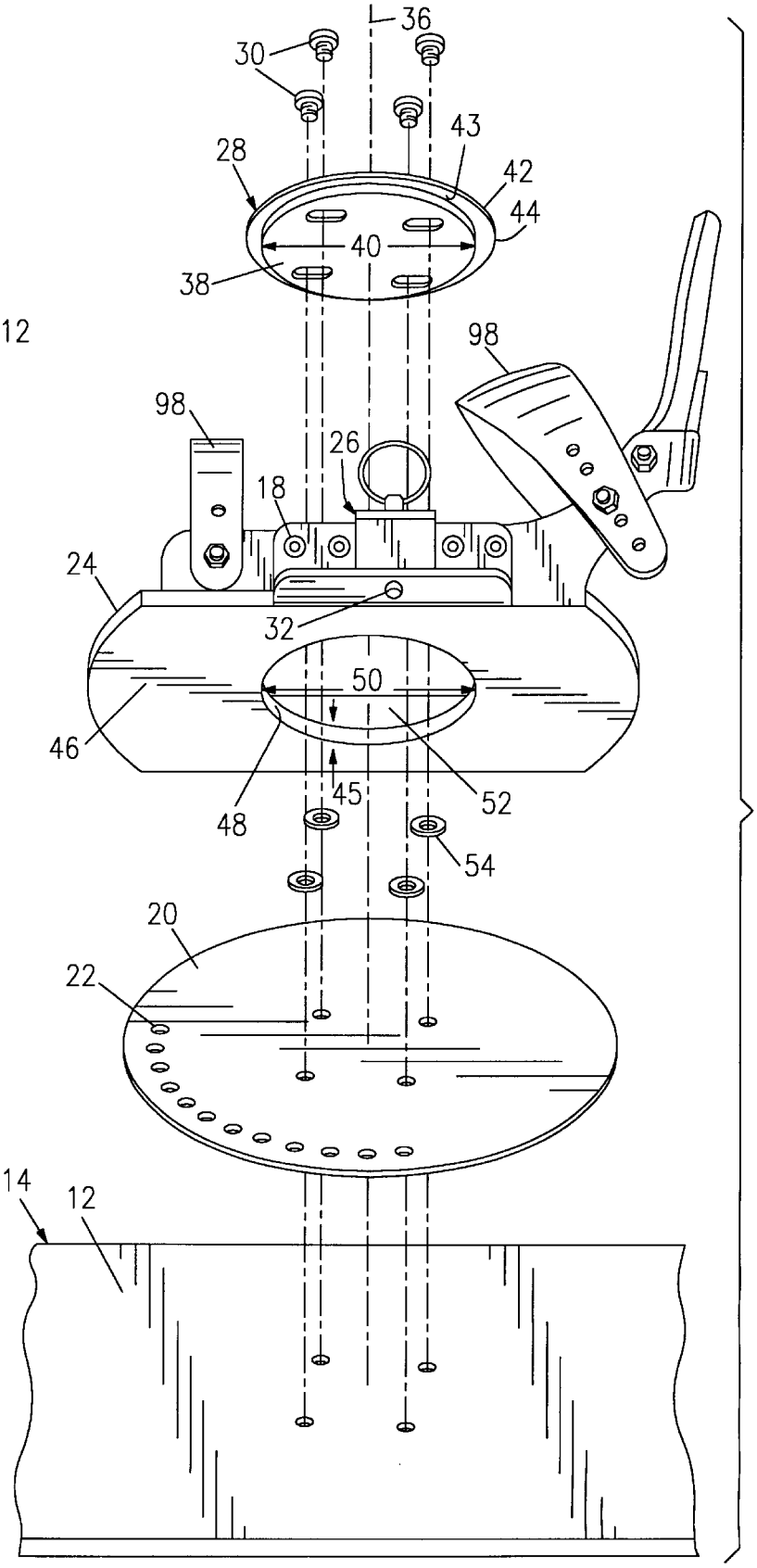
FIG. 2

PIVOTALLY ADJUSTABLE BINDING FOR SNOWBOARDS

BACKGROUND OF THE INVENTION

1. Field of the Invention

This invention relates to bindings for snowboards.

2. Background of the Invention

The sport of snowboarding is a relatively new sport that has exploded in popularity during the 1990's. However, the bindings which hold the snowboarder's boots in place on the snowboard are substantially the same as the bindings used for snow skiing without regard to the very different functional needs of snowboarders. Currently, the snowboarder's bindings are bolted into place. To change the angle of the bindings requires the snowboarder to remove their boot from the board and, using a screwdriver, unbolt the bindings and reset them to a different angle. This is a complicated and time-consuming process which cannot be practically done while on the slopes or between snowboarding runs. This is a serious disadvantage in snowboarding for the following reasons:

A snowboarder positions his or her feet at an angle on the snowboard to steer the snowboard down the slope. To accommodate the differing needs of snowboard athletes, it is very important that the angle of the bindings be adjustable. Moreover, changing snow conditions can be a reason why one may desire to change the angle of the bindings to change the ride of the snowboard. For example, the snowboarder may want to reverse the facing of the bindings so that they can change the leading foot on the snowboard from the right foot to the left foot much as a "goofy footed" surfer does on a surfboard.

Furthermore, the prior art binding restricts a snowboarder's ability to ride ski-lifts to return to the top of the slopes to continue their activities. Since, the snowboard bindings, and therefore the snowboarder's feet, are set at an angle, roughly 45° from perpendicular to the edge of the snowboard, it is difficult to sit in a normal position on the ski-lift. It is even more difficult when two people must sit next to each other on the lift, as they typically must on a ski-lift. The angle of the bindings causes the two riders' snowboards to bump together during the ride. A snowboarder must sit at an uncomfortable or even unsafe angle while on the ski-lift chair or more commonly, the snowboarder must remove their rear foot from the board to straighten out the board and ride the lift. The uncomfortable angle causes pain in both the ankles and knees of the user, especially after a full day on the slopes. The pain can last for days after one has been snowboarding.

Removing the rear foot to partially alleviate the pain presents the snowboarder with several problems. First, the front foot remains at the permanent angle of the snowboard binding while ascending the slope on the lift. This can be uncomfortable because without the rear foot in place, the weight of the snowboard is hanging, at an angle, off of just the front foot. Once, the snowboarder reaches the top, they must re-bind their rear foot to the snowboard. Typically, this involves considerable time and effort on the part of the snowboarder because they must insure that the bindings are secure and comfortable. Finally, in order to re-bind the rear foot, a snowboarder must sit down, usually in the snow. Thus, to re-bind the rear foot, the snowboarder must endure the discomfort of sitting in the wet, cold snow and then he or she must stand up after both feet are bound to the snowboard, which can be a difficult task in itself.

Each of these activities, changing the angle of the bindings and re-binding the rear foot after using the ski lift, takes valuable time. Since lift tickets for ski slopes can cost several hundred dollars, a snowboarder wishes to spend as much time as possible snowboarding as opposed to the abovementioned activities. Hence, a need exists for bindings whose angle can be readily and easily adjusted while the snowboarder's boots remain bound to a snowboard but will still remain locked while the snowboard is in use on the slopes.

SUMMARY OF THE INVENTION

The present invention is directed to bindings for a snowboard that satisfies the needs identified above: readily and easily able to adjust the bindings' angle yet the bindings remains locked while in use. With this invention, the snowboarder, by pulling on a single ring, can pivot the bindings while his or her boots are still in place. The snowboarder, therefore, needs no tools to change the angle of the bindings and can easily change the angle between snowboard runs, the snowboarder need not remove his or her foot to alter the angle thereby necessitating readjustment of the straps holding the boots for comfort and security, and the snowboarder need not remove his or her rear foot in order to ride the ski-lift.

This version of the invention allows the snowboarder to lift the locking pin from one of the pin receiving means on the perimeter of the base plate with the pull ring and pivot his or her binding around the pivot plate. When the snowboarder finds the proper angle for the bindings, he or she can release the pull ring and the spring will push the locking pin into the pin receiving means on the base plate, thus locking the binding into place at the desired angle.

These and other objects and advantages of the present invention will become apparent from the following detailed description of the preferred embodiment of the invention without intending to limit the scope of the invention which is set forth in the appended claims.

DETAILED DESCRIPTION OF THE DRAWINGS

The advantages of the invention can be more clearly understood by reference to the drawings in which:

FIG. 1 is top view of a preferred version of the invention attached to a snowboard.

FIG. 2 is an exploded view of a preferred version of the invention attached to a snowboard.

DETAILED DESCRIPTION OF THE PREFERRED EMBODIMENT

Figure 3:
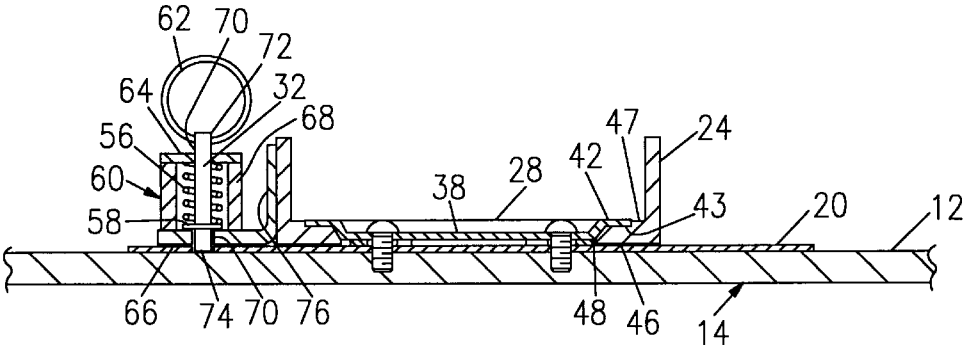
FIG. 3 is a cross-sectional view of a preferred version of the invention.

FIG. 1 illustrates the present invention 10, a pivotally adjustable snowboard binding, mounted on a top surface 12 of a snowboard 14 having a longitudinal axis 16. The preferred embodiment of the invention includes (i) a base plate 20 having a plurality of receiving means 22 positioned about the perimeter of the base plate 20; (ii) a binding platform 24 for securing the user's foot to the snowboard; (iii) a locking mechanism 26 for securing the binding platform at a desired angle by engaging the receiving means 22 in the base plate 20; and (iv) a pivot plate 28 for allowing the binding platform to swivel when the user adjusts the angle.

The base plate 20 is a substantially planar disk made of metal and is secured to the top surface 12 of the snowboard by any conventional means such as bolts 30. A typical snowboard is approximately 5 to 12 inches across and 50–70 inches long. To fit the base plate 20 within the top surface 12 of the snowboard, the base plate preferably has a diameter of 8½ inches. FIG. 2 shows a base plate that is circular, however, the plate itself can be any planar shape. The base plate 20 includes a plurality of receiving means 22 formed along a radial 90° arc. In FIG. 2, the receiving means 22 are simply holes, that have been drilled into the metal base plate 20. Preferably, the holes should be drilled every 5° to 10°. The primary function of the receiving means 22 is to accommodate a locking pin 32 to secure the binding platform in place at the desired angle. The number of receiving means 22 is purely a matter of design choice. The greater the number of receiving means 22, the greater the number of angles in which one can position the snowboard platform 24. Having receiving means 22 positioned through a full 90° range of motion insures that the binding 24 can be positioned perpendicular to the longitudinal axis 16 of the snowboard 14 for positioning the user's feet sideways on the board 14 or parallel with the longitudinal axis 16 for placing the foot in alignment with the snowboard 14. If the receiving means 22 is positioned through a 180° circular arc, then the invention can be used to change the lead foot from the right to the left foot.

Figure 4:
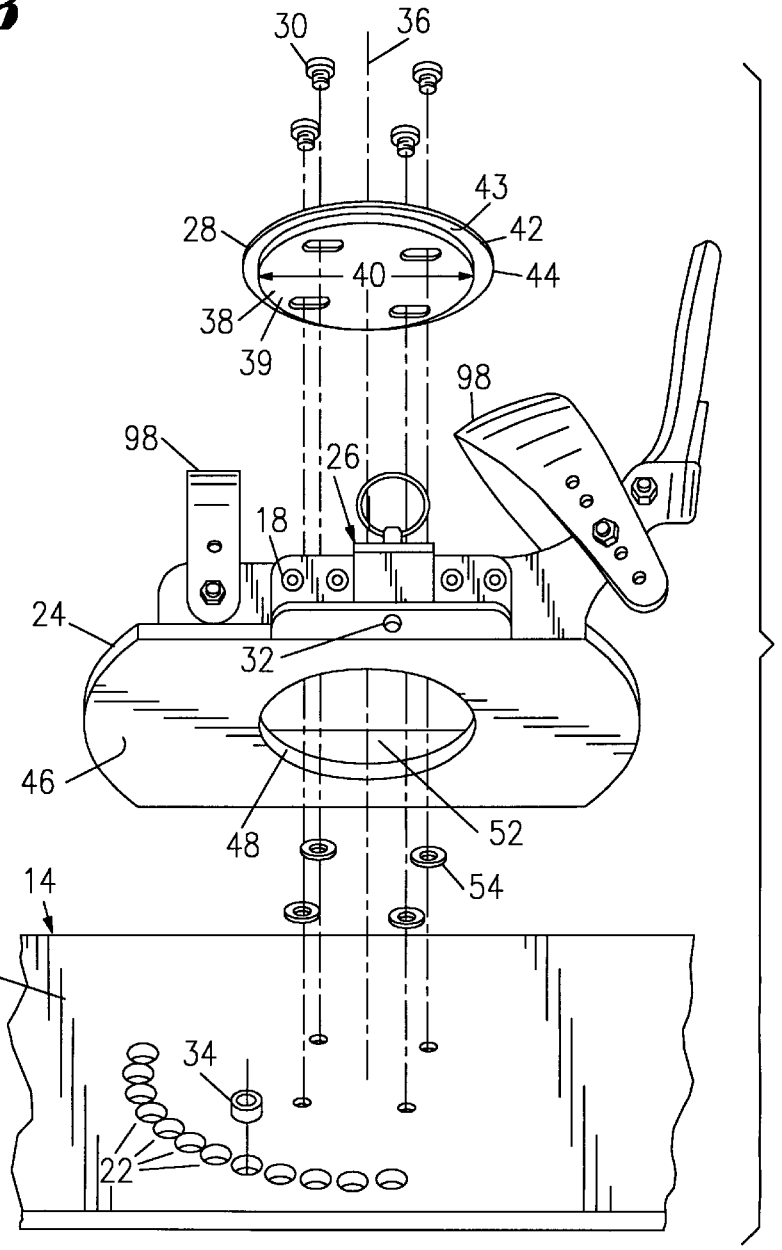
FIG. 4 is a top view of a preferred version of a locking plate with holes around the perimeter of the locking plate for adjusting the angle of the bindings.

It is important to note that the present invention does not require a base plate 20. In an alternative embodiment, the receiving means 22 are formed directly in the top surface 12 of the snowboard 14 as shown in FIG. 4. The snowboard 14 may not be made of material that is as strong as the base plate 20. To provide additional structural support, a sheath 34 may be secured within the receiving means 22 formed in the board 14 to reduce the likelihood that the board may be damaged by the locking pin 32 rubbing against the inner surface of the receiving means 22. Additionally, even when the base plate 20 is used, receiving means 22 may be formed in both the base plate 20 and in the board 14, which are aligned with each other so that the locking pin 32 passes through both the base plate 20 and the board 14.

The binding platform 24 is a conventional snowboard binding having any standard foot retention means such as foot straps 98 as shown in FIG. 2. The present invention requires that the binding platform 24 be permitted to swivel about a central, vertical axis 36. In FIG. 2, the means for permitting the binding 24 to swivel is a pivot plate 28. The pivot plate 28 has an inner circular disk 38 having a bottom surface 39 and a disk diameter 40. The pivot plate also includes a raised annular lip or flange 42 formed about the circumference of the inner circular disk 38. The annular lip 42 has a bottom surface 43. The pivot plate has an outer diameter 44, which includes both the inner disk 38 and the annular lip 42. In the preferred embodiment, the entire pivot plate 28 is approximately 4 inches in diameter and the inner disk 38 is approximately 3¼ inches in diameter leaving an annular lip 42 of approximately ¼ inch in width. Any size pivot plate 44 can be used, but using a larger size pivot plate 44 that takes advantage of the full width of the bottom sole 46 adds stability to the invention.

The binding platform 24 must be constructed to accommodate the pivot means or pivot plate 28. In this regard, the binding platform 24 has a bottom sole 46 having a thickness 45. The bottom sole 46 also has a circular rim 48 formed centrally therein, which has a rim diameter 50. The rim 48 defines a circular space 52. The diameter 50 of the circular rim 48 must be greater than the diameter 40 of the inner disk 38. This construction permits the inner circular disk 38 to be seated within the circular space 52. A rim 48 that is 3 5/16 inches in diameter can work effectively with a circular disk 38 that is 3¼ inches in diameter. The invention includes any conventional attachment means for securing the inner disk 38 to the top surface 12 of the snowboard 14. As shown in FIG. 2, the attachment means can be bolts 30, which pass through the inner disk 38 securing the pivot plate 28 to the base plate 20 and the board 14. Conventional washers 54 can be used between the base plate 20 and the bottom sole 46. The bottom sole 46 has a top surface 47. The annular lip 42 extends over the top surface 47 of the bottom sole 46, which serves to secure the binding platform 24 to the board 14 as shown in FIG. 3. A lip 42 that is ¼ inch radially across can effectively serve its purpose.

The pivot plate 28 should not be secured to the base plate 20 or the board 14 too tightly or else the bottom surface 43 of the lip 42 will bind against the top surface 47 of the bottom sole 46, which will inhibit the ability of the binding 24 to pivot when changing the angle of the binding. Another way to address this problem is to insure that the distance from the bottom surface 39 of the inner disk 38 to the bottom surface 43 of the lip 42 is slightly greater than the thickness 45 of the bottom sole 46. This will reduce the likelihood that the pivot plate 28 will be too tightly bound against the bottom sole 46. The problem of the pivot plate 28 binding too tightly to the bottom sole 46 can also be ameliorated by the use of washers 54 that raise the pivot plate thereby allowing additional space between the lip 42 and the bottom sole 46.

There are alternative possible constructions of the pivot plate 28. For example, the bottom sole 46 could be fixed on a shaft that rotates within a coupling located in the board. However, such a configuration is less stable and less effective than the preferred construction shown in the drawings.

It is important to note that the pivot plate 28 need not be an actual plate or disk. Other geometric configurations would serve the same function. For example, the inner disk 38 of the pivot plate 28 could be replaced with cross-bars that could be secured by any conventional means to the base plate 20 or board 14. Such a construction would still fall within the definition of a pivot plate as envisioned by the present inventors. Additionally, the annular lip 42 need not extend around the entire circumference of the inner disk 38. The raised lip 42 could project from the inner disk 38 at, for example, three equally spaced locations around the circumference of the inner disk 38. Such a construction would still fall within the definition of a raised lip or flange in accordance with the present invention.

The locking mechanism 26 is defined as any locking means that prevents the binding platform 24 from swiveling about the pivot plate 28 when the snowboard 14 is in use. In the preferred embodiment, the locking mechanism 26 includes an engaging means 32, a biasing means 56, a pin flange 58, a housing 60, and a grip means 62. The housing has a top section 64 and a bottom section 66, which may be connected by side walls 68. While the housing shown in the figures is rectangular, the shape of the housing is not necessarily critical to its function. The top and bottom sections 64, 66 have holes 70 formed therein, which are aligned with each other to permit the engaging means 32 to pass through the top section 64 and the bottom section 66 of the housing 60 at the same time.

The engaging means 32 is shown in the preferred embodiment in the figures as a locking pin 32. The locking pin 32 has a top end 72 and a bottom end 74. The grip means can take the form of a conventional pull ring 62 secured to the locking pin 32 in proximity to the top end 72 and exterior to the housing 60. However, any other conventional grip means could also be used. Other possible examples includes a cross bar passing through the top end 72 perpendicular to the locking pin 32 forming a T would serve the same function, or indentations could be formed in the sides of the locking pin 32 to serve as finger grips.

The pin flange 58 may be integrally formed with the locking pin 32 or secured to it, but in either case, the flange must have a diameter greater than the diameter of the hole 70 in the bottom portion 66 of the housing 60. The distance between the bottom end 74 and the pin flange 58 must be of sufficient length to permit the locking pin 32 to engage the receiving means 22 in the base plate 20. If the pin flange 58 is located too close to the bottom end 74, then the locking pin 32 will not be able to engage the receiving means 22. A locking pin 32 that is 1½ inches long having a pin flange 58 that is ¼ inch from the bottom end 74 can work effectively where the housing is 1 inch tall. In such a case, the receiving means 22 can work effectively if it is 1/16 inch deep.

In the preferred embodiment, the biasing means is shown as a spring 56. The spring 56 fits within the housing 60 between the pin flange and the top portion 64. When the ring 62 is pulled upward, the pin flange 58 rises thereby compressing the spring 56 and withdrawing the locking pin 32 from the receiving means 22. This permits the user to swivel the binding 24 to a new position. After the new position has been selected, the ring 62 is released and the spring 56 will apply a force downward on the pin flange 58 driving the bottom end 74 into the new receiving means 22. The downward force of the spring 56 prevents the pin 32 from coming out of the receiving means 22.

The locking mechanism 26 may be secured to the binding platform 24 by any attachment means. In the preferred embodiment, the bottom portion 66 of the housing 60 extends beyond the housing to form a bracket 76, which is secured to the binding platform 24 by metal screws 18. The locking mechanism 26 must be secured to the binding 24 so that the locking pin 32 will be in alignment with the receiving means through the full range of motion allowed by the pivot plate 28.

The drawings show the locking mechanism 26 located above the receiving means 22. An alternative construction could include an elongated annular bracket having receiving means in which the bracket is positioned perpendicular to the top surface 12 of the board 14. In such a case, the locking pin 32 would be horizontally positioned parallel to the surface 12 of the board 14 for engaging the receiving means in the annular bracket. Additional actuating means may be added to comfortably pull the locking pin out of the receiving means in the bracket. Clearly, other angles of engagement between the locking pin and the receiving means could also be designed other than the vertical engagement shown in the drawing and the horizontal engagement described above but not shown.

Figure 5:
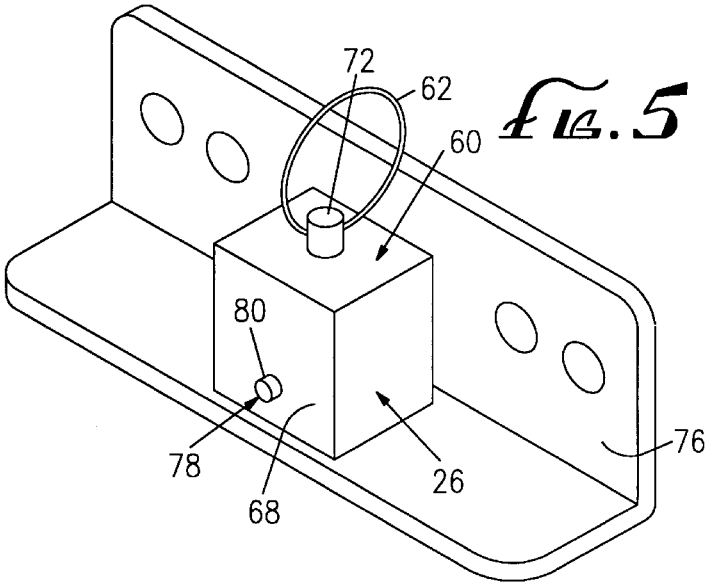
FIG. 5 is a perspective view of a preferred version of the locking pin and indicator button assembly.
Figure 6:
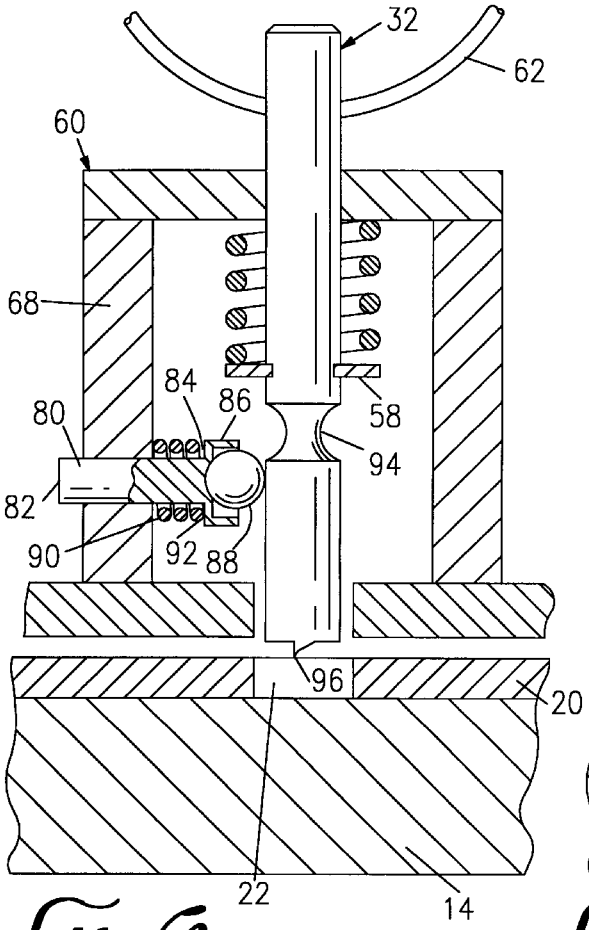
FIG. 6 is a cross-sectional view of a preferred version of the locking pin and indicator button assembly where the cylindrical dowel is disengaged.
Figure 7:
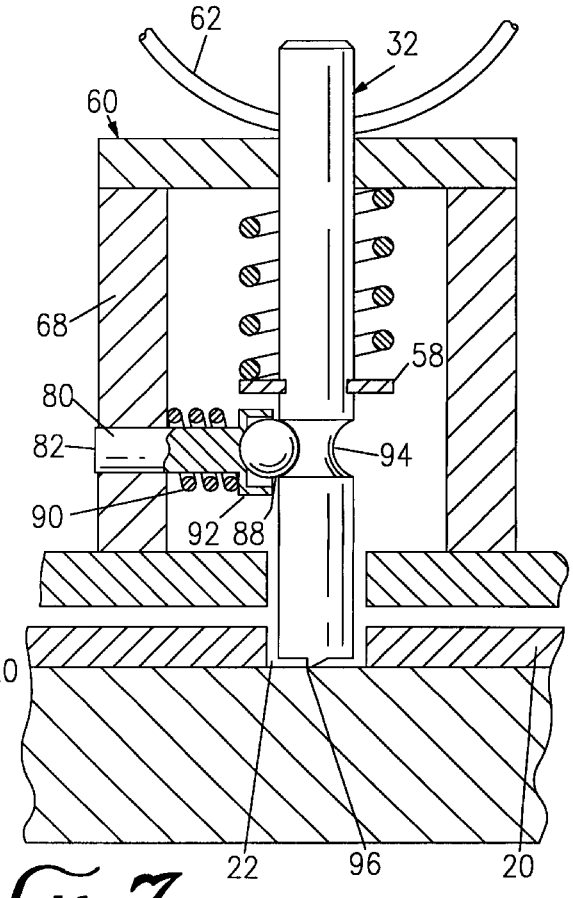
FIG. 7 is a cross-sectional view of a preferred version of the locking pin and indicator button assembly where the cylindrical dowel is engaged.

FIGS. 5, 6 and 7 depict another preferred embodiment of the invention. The locking mechanism 26 in this embodiment also includes an indicator assembly 78. The indicator assembly includes an indicator shaft 80 having an exterior end 82 and an interior end 84. The indicator shaft 80 is substantially perpendicular to the locking pin 32, and the exterior end 82 projects through the side wall 68 of the housing 60 to serve as an indicator button. The interior end 84 includes a receptacle 86 of sufficient size to accommodate a ball bearing 88. The receptacle 86 also has a rear surface 92. A indicator spring 90 encircles the indicator shaft 80 and is compressed between the wall 68 of the housing 60 and the rear surface of the receptacle 86, which resists extension of the exterior end 82 of the indicator shaft 80 beyond the surface of the housing 32.

Additionally, in the embodiment in FIGS. 5, 6 and 7, the locking pin 32 has a recess 94 located between the pin flange 58 and the bottom end 74 of the pin 32. The recess 94 should be formed in the pin 32 at a sufficient distance from the bottom end 74 so that the ball bearing 88 will engage the recess 94 when the bottom end 74 of the pin 32 is fully inserted in the receiving means 22. When the locking pin 32 is pulled out of the receiving means 22 by the user's operation of the grip means 62, the ball bearing 88 will roll out of the recess 94 and force the indicator shaft 80 to extend beyond the surface of the housing 32 as shown in FIG. 6. When the locking pin 32 is fully seated in one of the receiving means 22, then the ball bearing 88 will seat itself in the recess 94 thereby causing the exterior end 82 to be flush with the surface of the housing 60 as shown in FIG. 7. Thus, if the receiving means 22 are blocked with a foreign obstruction or the user has not properly seated the locking pin 32 in one of the receiving means 22, then user will be able to see and/or feel that the indicator shaft 80 is not flush with the housing 60 indicating that the bindings 10 are not fully in the locked position. When the locking pin 32 is properly seated, the indicator shaft 80 will be flush with the surface of the housing 60 and the user will know that the bindings 24 are locked and safe to use.

Figure 8:
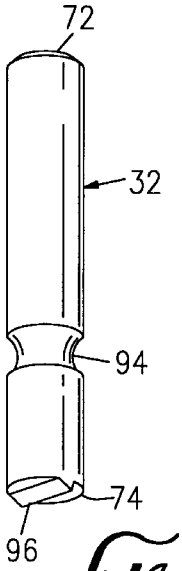
FIG. 8 is a perspective view of a preferred version of the cylindrical dowel.

Another feature of the preferred embodiment of the invention is depicted in FIGS. 6, 7 and 8. In this embodiment, the bottom end 74 of the locking pin 32 includes a projection 96 inserted into the holes 22 of the base plate 20. By using the grip means 62, the user can rotate the locking pin 32 and use the projection 96 to remove ice, snow, dirt or other obstructions from the receiving means 22. For this feature to be maximally effective, it is preferred that the recess 94 encircle the locking pin 32 so that the user can rotate the pin 32 in a complete circle to remove obstructions when the ball bearing 88 is in the recess 94 as shown in FIG. 7. The projection 96 may also be used through rotational movement of the pin 32 when the ball bearing 88 is not in the recess 94 as shown in FIG. 6. The projection 96 shown in FIG. 8 is elongated and triangular, however any shape that is effective to break up ice and debris would be acceptable.

Although the present invention has been described in considerable detail with reference to certain preferred versions thereof, other versions are possible. For example, the preferred version of the base plate 20, pivot plate 28 and locking pin assembly 32 are made from aluminium. However, other materials could be used such as plastics, titanium, stainless steel or other metal alloys or a combination of metal and plastic. The bindings platform 24 is made mostly of plastics with metal buckles and screws. Again, other materials could be used such as plastics, stainless steel, aluminum or a combination of metals and plastics.

The preferred version of the bindings platform 24 contains a standard strap and buckle binding 28 as means for attaching the snowboarder's boot to the bindings platform. Such means could also take the form of metal latches, permanently attached boots or a partial boot with a removable boot casing. Therefore, the spirit and scope of the appended claims should not be limited to the description of the preferred versions contained herein.

What is claimed is:

1. A binding for snowboards, the snowboard having a top surface, the binding comprising:

a base plate secured to said top surface of said snowboard and having a plurality of receiving means;

a binding platform having a bottom sole in which a circular rim is formed, and bottom sole having a top surface;

a pivot plate having a raised annular lip, said pivot plate fitting within said circular rim while said raised annular lip extends over said top surface of said sole, said pivot plate also having a central axis and having attachment means for securing said pivot plate and base plate to said top surface of said snowboard while permitting rotation of said binding platform relative thereto;

a locking mechanism having a locking pin with a top end and a bottom end, said top end including grip means, said locking mechanism secured to said binding platform said locking mechanism further comprises:

a housing having a top, a bottom, and at least one sidewall, said locking pin passing through said top and said bottom; said locking pin including a flange; and, a first spring located within said housing in compression between said flange and said top of said housing for biasing the lower end of said locking pin into said receiving means;

an indicator shaft having an exterior end and an interior end, said exterior end passing through said sidewall perpendicular to said locking pin, said interior end including a receptacle for receiving a ball bearing, a second spring encircling said indicator shaft and compressed between said sidewall and said receptacle for biasing said interior end towards said locking pin; and a recess located in said locking pin for receiving said ball bearing, said indicator shaft of a length such that said exterior end of said shaft is flush with an exterior surface of said sidewall when said ball bearing is seated in said recess and said recess being positioned along said locking pin so that said ball bearing will seat in said recess only when said locking pin is fully engaged in said receiving means for indicating when the locking pin is in a fully locked position, said plurality of receiving means being radially distributed about said central axis and positioned in proximity to said locking pin to permit said locking pin to be inserted into said receiving means when said binding platform is rotated about said central axis thereby permitting said locking mechanism to prevent rotational movement of said binding platform.

2. A binding for snowboards as in claim 1 wherein said recess fully encircles said locking pin.

3. A binding for snowboards, the snowboard having a top surface, the binding comprising:

a base plate secured to said top surface of said snowboard and having a plurality of receiving means;

a binding platform having a bottom sole in which a circular rim is formed, said bottom sole having a top surface;

a pivot plate having a raised annular lip, said pivot plate fitting within said circular rim while said raised annular lip extends over said top surface of said sole, said pivot plate also having a central axis and having attachment means for securing said pivot plate and said base plate to said top surface of said snowboard while permitting rotation of said binding platform relative thereto;

a locking mechanism having a locking pin with a top end and a bottom end, said top end including grip means, said bottom end being selectively receivable within said plurality of receiving means, said locking mechanism secured to said binding platform, said bottom end of said locking pin includes a substantially horizontal planar bottom surface with a projection extending downwardly therefrom for breaking up foreign matter that may become lodged in the receiving means, said plurality of receiving means being radially distributed about said central axis and positioned in proximity to said locking pin to permit said locking pin to be inserted into said receiving means when said binding platform is rotated about said central axis thereby permitting said locking mechanism to prevent rotational movement of said binding platform.

* * * * *